United States Patent [19]

Nelson et al.

[11] Patent Number: 4,666,676

[45] Date of Patent: May 19, 1987

[54] RADIOACTIVE WASTE PROCESSING APPARATUS

[75] Inventors: Robert E. Nelson, Lombard; Anton A. Ziegler, Darien, both of Ill.; David F. Serino, Maplewood, Minn.; Paul J. Basnar, Western Springs, Ill.

[73] Assignee: The United States of America as represented by the United States Department of Energy, Washington, D.C.

[21] Appl. No.: 770,908

[22] Filed: Aug. 30, 1985

[51] Int. Cl.[4] ..... G21C 13/00; G21F 9/16; G21F 9/08

[52] U.S. Cl. ..... 422/159; 141/339; 141/372; 220/361; 250/435; 250/506.1; 252/628; 252/631; 252/633; 366/92; 366/98; 366/182; 366/204; 366/207; 366/251; 366/254; 366/261; 366/282; 366/283; 366/285; 366/347

[58] Field of Search ..... 252/631, 633, 628, 626; 366/149, 199, 201, 204, 206, 207, 209, 244, 245, 247, 248, 249, 251, 261, 282, 285, 347, 92, 97, 98, 100, 182, 254; 422/159; 250/506.1; 425/203, 207; 141/339, 372; 220/361

[56] References Cited

U.S. PATENT DOCUMENTS

| | | | |
|---|---|---|---|
| 3,513,100 | 5/1970 | Stogner | 252/628 |
| 3,749,917 | 7/1973 | Kucherer | 250/506.1 |
| 3,862,748 | 1/1975 | Grise et al. | 366/248 |
| 3,883,441 | 5/1975 | Murphy et al. | 252/633 |
| 3,894,723 | 7/1975 | Sanders et al. | 366/248 |
| 3,940,628 | 2/1976 | Stock et al. | 137/578 |
| 3,952,538 | 4/1976 | Warlick | 366/204 |
| 4,030,708 | 6/1977 | Stock et al. | 137/578 |
| 4,122,028 | 10/1978 | Iffland et al. | 252/628 |
| 4,168,243 | 9/1979 | Gablin | 252/628 |
| 4,176,969 | 12/1979 | Wallace et al. | 366/149 |
| 4,185,072 | 1/1980 | Puderbaugh et al. | 366/248 |
| 4,194,842 | 3/1980 | Puthawala | 366/149 |
| 4,234,447 | 11/1980 | Hay, II et al. | 252/628 |
| 4,234,448 | 11/1980 | Hirano et al. | 366/245 |
| 4,252,667 | 2/1981 | Stegmaier et al. | 366/149 |

OTHER PUBLICATIONS

Winsch, et al., 1980, Light Water Breeder Reactor Proof-of-Breeding Analytical Support Project, Argonne National Laboratory, pp. 83–90.

*Primary Examiner*—Stephen J. Lechert, Jr.
*Assistant Examiner*—Howard J. Locker
*Attorney, Agent, or Firm*—Hugh W. Glenn; Robert J. Fisher; Judson R. Hightower

[57] ABSTRACT

Apparatus for use in processing radioactive waste materials for shipment and storage in solid form in a container is disclosed. The container includes a top, and an opening in the top which is smaller than the outer circumference of the container.

The apparatus includes an enclosure into which the container is placed, solution feed apparatus for adding a solution containing radioactive waste materials into the container through the container opening, and at least one rotatable blade for blending the solution with a fixing agent such as cement or the like as the solution is added into the container.

The blade is constructed so that it can pass through the opening in the top of the container. The rotational axis of the blade is displaced from the center of the blade so that after the blade passes through the opening, the blade and container can be adjusted so that one edge of the blade is adjacent the cylindrical wall of the container, to insure thorough mixing.

When the blade is inside the container, a substantially sealed chamber is formed to contain vapors created by the chemical action of the waste solution and fixant, and vapors emanating through the opening in the container.

1 Claim, 4 Drawing Figures

RADIOACTIVE WASTE PROCESSING APPARATUS

CONTRACTUAL ORIGIN OF THE INVENTION

The U.S. Government has rights in this invention under Contract No. W-31-109-ENG-38 between the Department of Energy and The University of Chicago representing Argonne National Laboratory.

BACKGROUND OF THE INVENTION

This invention relates to appartus for processing liquid radioactive waste materials, and more particularly, to apparatus for processing such materials for shipment and storage in solid form.

There are many methods of disposing of radioactive waste materials. One method is to mix the radioactive waste with cement or the like, let the mixture harden in one or more containers, and ship the containers to a storage site.

Solid radioactive waste materials may be too highly radioactive to be shipped safely. For example, waste fuel from nuclear power plants may have radiation levels of between about 500 R/hr and about 1,000 R/hr. Such levels are very dangerous.

Radiation levels of about 100 mR/hr are considered safe for transport. In order to reduce the radioactivity of highly radioactive solid waste materials, the materials may be dissolved and diluted to produce a waste solution having a reduced concentration of radiation. A liquid containing nitric acid is desirable for producing such solutions because it dissolves commonly encountered radioactive waste materials.

In order to fix a solution containing radioactive waste materials in solid form, the solution must be mixed with cement or some other fixing agent in a suitable container. Desired levels of radiation may be achieved by controlling the ratio of the waste materials to fixant. After the mixture hardens, cures and is dehydrated, the container may be transported to an appropriate site for storage, after packaging in proper containers.

Under normal circumstances, the volumetric ratio of waste solution to fixant is substantially less than one. The ratio might be as low as 0.02. In such situations, it is not uncommon to put the fixing agent into the container in slurry form first, and slowly meter the solution into the container while constantly blending the mixture. However, the mixing process creates radioactive vapors which could be very harmful if they are permitted to escape into a work area or into the atmosphere. Mixing may be performed in a sealed chamber to contain such vapors, but the vapors must be substantially eliminated before the chamber is unsealed to remove the containers. Thus, there is a need for apparatus for fixing radioactive waste in solid form which controls vapors created by the mixing and setting process.

The liquid radioactive waste materials and fixing agent should be blended to produce a homogeneous mixture in which the waste materials are evenly dispersed throughout the container. This may be accomplished by inserting rotatable blades into the mixture, rotating the blades for a suitable length of time, and removing the blades before the mixture hardens. If the top of the container has an opening of reduced size relative to the circumference of the container, the size of the blades must be reduced to allow it to fit through the opening. As a result, such blades do not extend to the wall of the container, and thorough blending of the mixture is difficult to achieve. Thus, there is a need for mixing blades which fit through an opening in a container, the opening being smaller than the outer circumference of the container, and the blades being capable of adjustment inside the container so that the blades pass adjacent to the inside surface of the container wall.

Accordingly, one object of this invention is to provide new and improved apparatus for processing radioactive waste materials.

Another object is to provide new and improved apparatus for processing radioactive waste materials for shipment and storage in solid form.

Still another object is to provide new and improved apparatus for controlling radioactive vapors in chambers containing radioactive waste materials.

Yet another object is to provide new and improved apparatus for inserting mixing blades through an opening in a container, the opening being smaller than the outer circumference of the container, and adjusting the blades and the container so that the blades extend adjacent to the inside of the wall of the container.

SUMMARY OF THE INVENTION

In keeping with one aspect of this invention, apparatus for processing radioactive waste materials for shipment and storage in solid form includes an enclosure and a container which may be placed in the enclosure. The container includes a generally cylindrical wall having a vertical axis, a bottom, and a top. The top has an opening which is smaller than the outer circumference of the container.

The enclosure includes apparatus to allow a solution containing radioactive waste materials to flow into the container through the container opening, and at least one rotatable blade for blending the solution with a fixing agent such as cement or the like as the solution flows into the container. The enclosure could be relatively small, to accommodate one container, or it could be as large as room-sized, to accommodate several containers, and could have more than one blade, if desired, for blending waste materials in more than one container at a time.

The blade is constructed so that it can pass through the opening in the top of the container. The rotational axis of the blade is displaced from the center of the blade so that after the blade passes through the opening, the blade and container can be adjusted so that one edge of the blade is adjacent the cylindrical wall of the container, to insure thorough mixing.

When the blade is inside the container, a substantially sealed chamber is formed to contain vapors created by the chemical action of the waste solution and fixant, and vapors emanating through the opening in the container. The chamber may be formed by placing a removable extension over the top of the container. When the extension communicates with the enclosure, such vapors are contained by the container, extension and enclosure. A portion of the chamber includes coolant which condenses the vapors. The resulting condensate is returned to the container by the force of gravity.

In operation, a desired amount of fixing agent may be poured into the container, and the container may be placed inside the enclosure. The extension may be placed on the top of the container, and the apparatus may be adjusted so that the blade extends through the opening, adjacent the container wall, and the chamber is formed and sealed. A predetermined amount of waste solution may then be metered into the container at a desired rate, and mixed. Radioactive vapors are condensed in the chamber and returned to the container by gravity. When the mixing process is completed and the vapors are substantially removed, the container may be removed from the enclosure while the mixture cures. The container may then be sealed and shipped for long-term storage.

BRIEF DESCRIPTION OF THE DRAWINGS

These and other features of this invention and the manner of obtaining them will become more apparent, and the invention itself will be best understood by reference to the following description of the invention taken in conjunction with the accompanying drawings in which.

DETAILED DESCRIPTION

Figure 1:
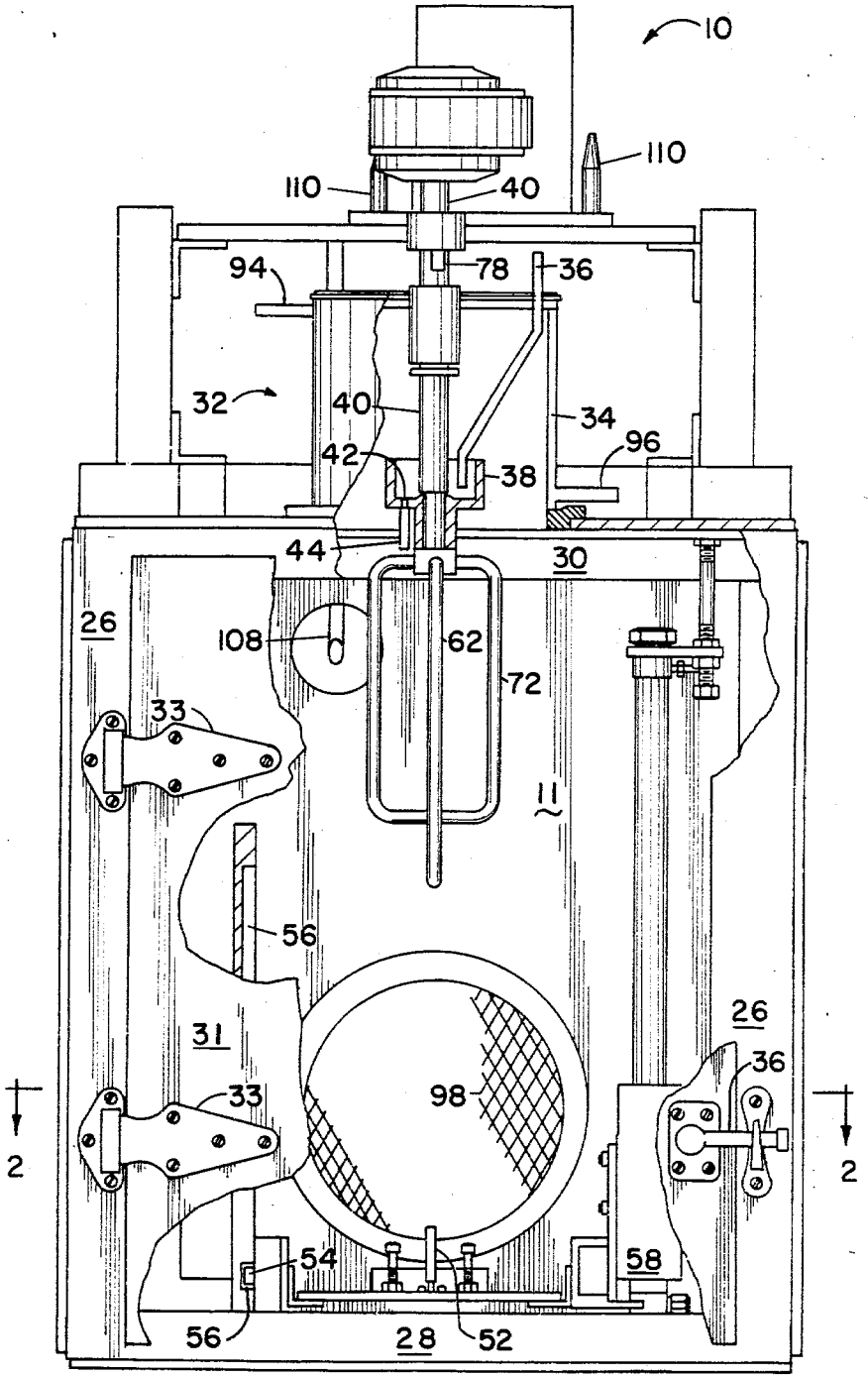
FIG. 1 is a partially cutaway front elevation view of the apparatus of this invention, with the container removed.

FIGS. 1–4 illustrate various aspects of apparatus 10 for processing radioactive waste materials for shipment and storage in solid form. The apparatus 10 includes an enclosure 11 and a container 12 (FIGS. 3 and 4) which may be placed in the enclosure 11.

The container 12 (FIG. 3) includes a generally cylindrical outer wall 14 having a vertical axis 16, a bottom 18 having an outer lip 20, and a top 22. The top 22 defines an opening 24 through which the container 12 may be filled.

The opening 24 is smaller than the outer circumference of the container 12. The container 12 can be a commercially available can similar to a paint can or the like, which is suitable for sealing with a press-fit lid after the mixture of waste materials and fixing agent are blended and cured.

The enclosure 11 includes a plurality of walls 26, a bottom 28 and a cover 30. The enclosure 11 may also include a door 31 (FIG. 1) hingedly secured to the enclosure 11 by hinges 33, and a latch 36 for keeping the door 31 closed to seal the inside of the enclosure 11.

The cover 30 includes solution feed apparatus 32. The solution feed apparatus 32 includes a case 34 secured to the cover 30, and a feed tube 36 which extends from waste solution metering apparatus (not shown) to a cup 38. The cup 38 is secured to a shaft 40 for rotation with the shaft 40. The cup 38 has an orifice 42 through which waste solution may flow from the cup 38, through a pipe 44, and into the container 12, as will be seen.

A tray 46 (FIG. 2) is provided for supporting the container 12 in the enclosure 11. The tray 46 is guided by slides 48 or other suitable means so that the tray 46 can be pulled out of the enclosure 11 when the container 12 is being loaded or unloaded.

Figure 2:
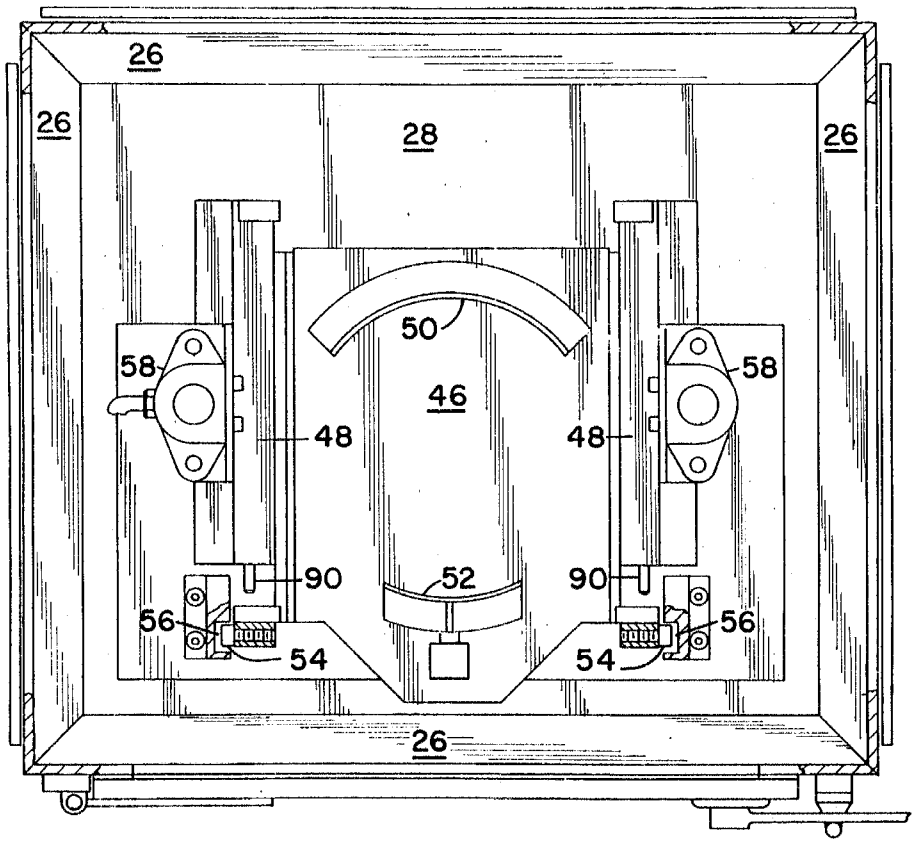
FIG. 2 is a detail view of the apparatus of FIG. 1, taken along lines 2—2 in FIG. 1.

The container 12 is secured to the tray 46 by a stationary clamp 50 and a movable clamp 52. The container 12 may be placed in the enclosure 11 after pulling the tray 46 out of the enclosure 11 and releasing the movable clamp 52. The container 12 is secured to the tray 46 by placing the lip 20 of the container 12 under the stationary clamp 50, and securing the movable clamp 52 over the lip 20. The tray 46 may then be returned to the enclosure 11, as shown in FIG. 2. The tray 46 is preferably pushed in until rollers 54 are aligned with vertical track guides 56, as shown in FIG. 2.

Lifting cylinders 58 (FIG. 1) are provided in the enclosure 11 so that the container 12 may be raised and lowered. The cylinders 58 are preferably double-acting for controlled up and down movement.

The track guides 56 (FIG. 3) control the lateral position of the tray 46 as the cylinders 58 move the tray 46 up and down. The track guides 56 have a slight lateral jog 60 so that when the container 12 rises vertically to a predetermined point, the track guides 56 shift the entire tray 46 and the container 12 laterally towards the back of the enclosure 11.

At least one rotatable blade 62 is provided for mixing the radioactive waste with the fixing agent. The blade 62 is secured to the shaft 40, and has a lateral width which is defined by two generally vertical edges 64, 66. The shaft 40 and the blade 62 are turned at a predetermined rate by a motor 68, through a gearbox 70.

An additional blade 72 may be provided, if desired, for more thorough blending of the mxture in the container 12. The blade 72 also has a lateral width which is less than the diameter of the opening 24.

The width of the blade 62 is less than the diameter of the opening 24 so that the blade 62 may pass through the opening 24. The blade 62 has a rotational axis 74 which is displaced from the center 76 of the blade 62 so that the distance between the rotational axis 74 and the edge 66, which is the furthest removed from the axis 74, is slightly less than the radius of the container 12. The displacement of the axis 74 from the center of the blade 62 permits the blade 62 to be positioned within the container 12 such that the edge 66 is adjacent to the wall 14.

The blade 62 also has a bend 77 which is provided so that the container 12 or adjacent apparatus does not come into contact with the blade 62 when the tray 46 is moved laterally back by the jog 60 in the track guides 56. An indicator blade 78 is secured to the shaft 40 outside of the enclosure 11, so that the operator can stop the blade 62 in the position shown in FIG. 3 when the container 12 is moved up or down.

Figure 3:
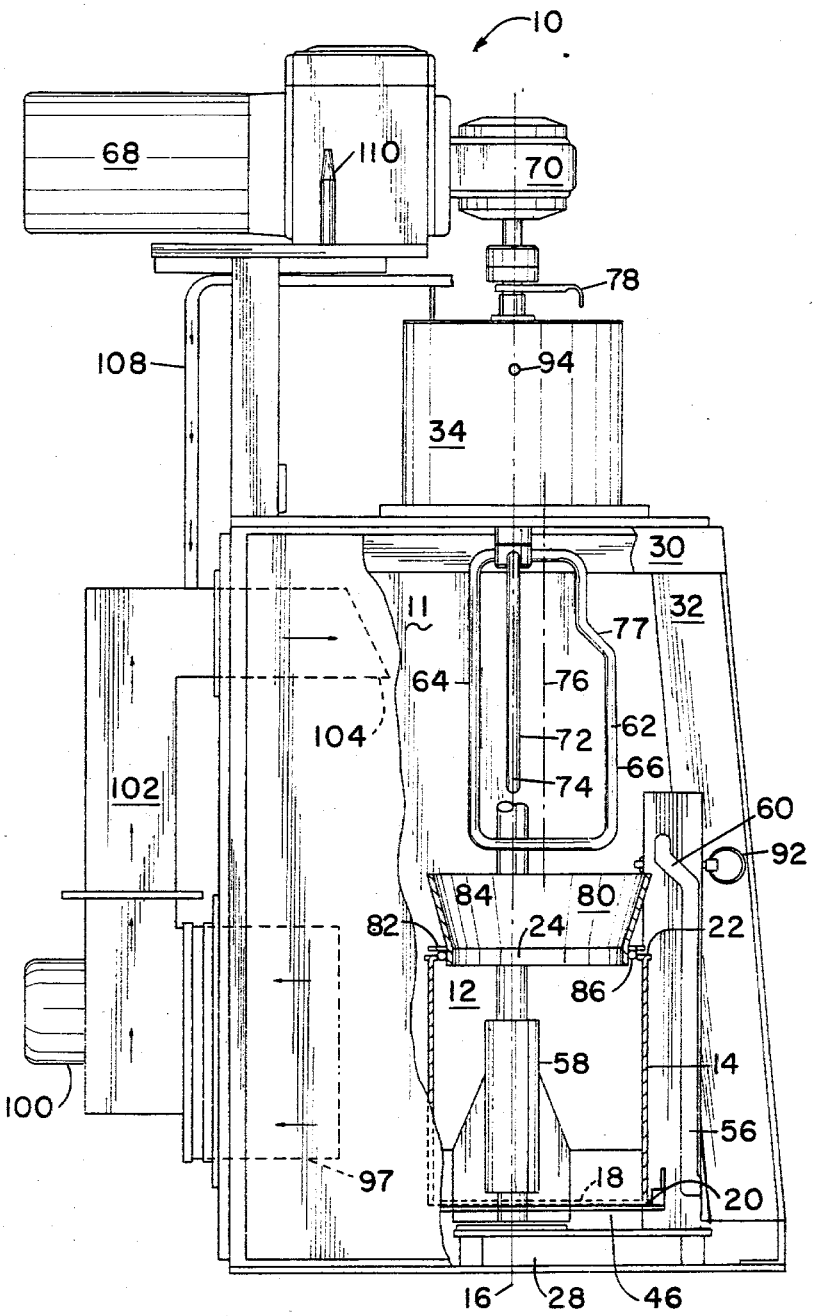
FIG. 3 is a partially cutaway side elevation view of the apparatus of this invention, including the container, showing the container in a lowered position.

A removable extension 80 is placed on the top 22 of the container 12, as seen in FIG. 3. The extension 80 is supported on the top 22 by a rim 82, and includes a funnelled wall 84 which slopes inwardly in the downward direction, and extends through the opening 24. A gasket 86 may be provided, if desired, for sealing purposes.

Figure 4:
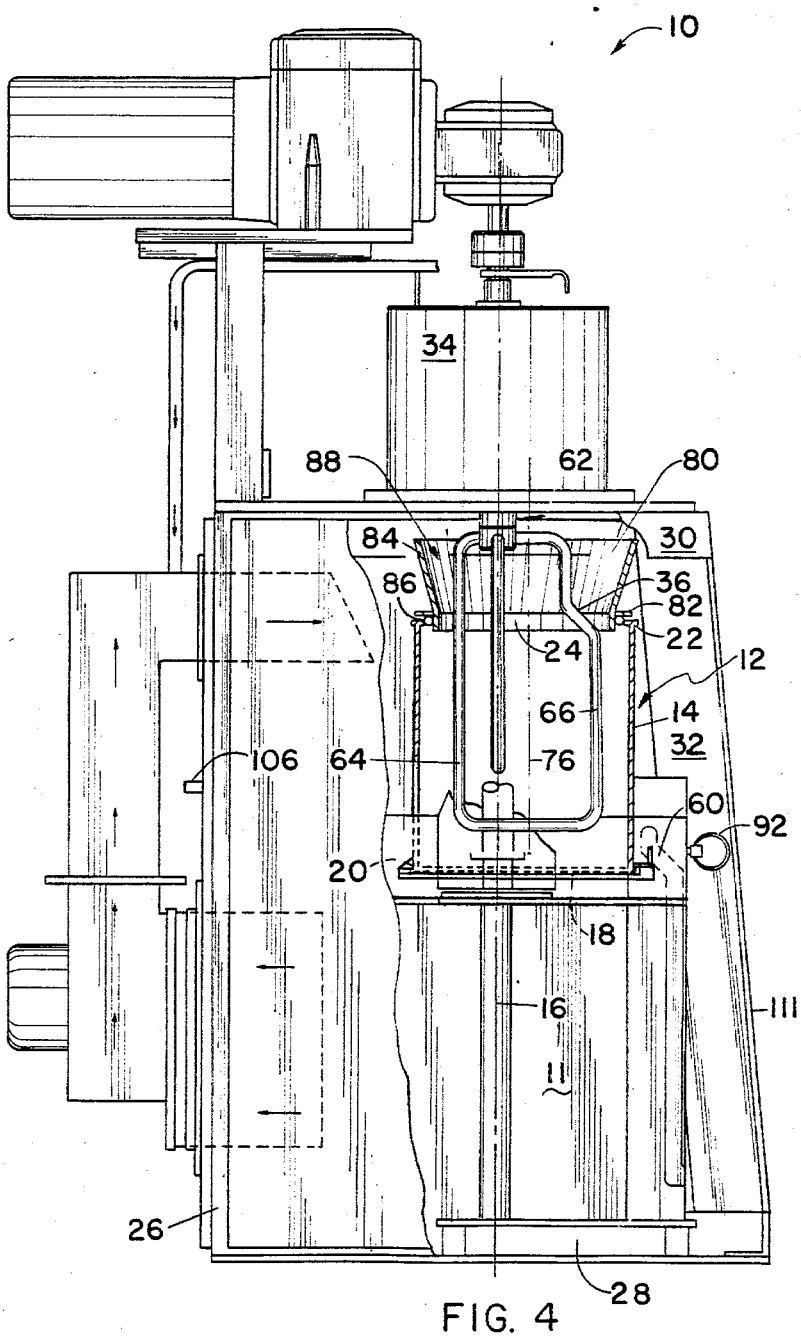
FIG. 4 is a partially cutaway side elevation view of the apparatus of this invention, including the container, showing the container in a raised position.

When the blade 62 is in the position shown in FIG. 3, the container 12 and extension 80 may be lifted up to the position shown in FIG. 4. When the top of the extension 80 meets the bottom of the case 34, a substantially sealed chamber 88 is formed by the cover 30 of the enclosure 11, the extension 80, and the container 12. The chamber 88 contains any vapors which are created by the chemical action of the waste solution and fixant, or which emanate through the opening 24 of the container 12.

When the container 12 is in the position shown in FIG. 4, the tray 46 slides over guide pins 90 (FIG. 2) in the slides 48, for added stability. A lock pin 92 (FIG. 3) may be inserted in the apparatus 10 beneath the container 12, if desired, to prevent the container 12 from accidentally dropping.

The case 34 includes internal jackets for cooling fluid such as water or the like, a water inlet 94, and a water outlet 96. The cooling fluid cools the case 34 so that vapors, which contact the case 34, are condensed. Gravity forces the condensate down the wall 84 of the extension 80 and through the opening 24.

If desired, the enclosure 11 may also include an air circulation and filtration system in which air is drawn through an air inlet 97 and a high density filter 98 (FIG. 1) by a fan motor 100. The filter 98 can be used to remove particulate contaminants from the air. The filtered air is circulated through a duct 102 to an air outlet 104 in the upper portion of the enclosure 11.

The air circulation and filtration system is particularly useful in removing radioactive particulate matter such as particulate solids emitted from radon gas, which evolves into a radioactive lead compound. While it is difficult to remove the radon in gaseous form, the lead compound may be removed easily in a high-density filter.

A safety valve 106 (FIG. 4) can be provided in the enclosure 11, if desired, as well as a safety air tube 108 (FIG. 1), which reduces the accumulation of hydrogen and other dangerous gases in the enclosure 11.

The entire apparatus 10 is adapted for operation and maintenance by remote control, to protect the operator from radiation. For example, the moveable clamp 52 and the door latch 36 are designed for easy manipulation by a robotic arm. Also, the motor 68 is mounted on pins 110, so that it may be removed and replaced by remote control.

The radioactive waste is preferably prepared in the form of a solution before it is put into the container 12. The solution may include sufficient nitric acid or other suitable chemicals to dissolve the waste materials.

An appropriate amount of fixing agent such as cement or the like is poured into the container 12 before the container 12 is placed in the enclosure 11. The fixing agent may include lime or some other chemical which neutralizes the acid in the solution.

After the fixing agent is poured into the container 12, the container 12 is placed on the tray 46 and pushed inside the enclosure 11. A desired amount of radioactive waste solution is then added. The radioactive waste solution is added into the container 12 over a period of several hours, during which time the blade 62 is turning at perhaps 100 revolutions per minute. During mixing, vapors in the chamber 88 are condensed on the case 34, and return to the container 12 by the force of gravity.

After mixing, the tray 46 and the container 12 are lowered and pulled out of the enclosure 11. The container 12 is unclamped, removed from the tray 46, and moved away for curing, which may be done at room temperature for several days and then at 100°-125° C. for several additional days. Thereafter, the container 12 is sealed, enclosed in appropriate containers and transported to a storage site.

The many advantages of this invention are now apparent. Radioactive waste materials may be processed for shipment and storage in solid form. Radioactive vapors created during processing may be controlled, and thorough blending of the waste materials with a fixing agent such as cement or the like may be achieved.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. Apparatus for use in processing liquid radioactive waste materials for storage in solid form in a container having a substantially cylindrical wall, the wall having a substantially vertical axis, and a top secured to the wall, the top having a container opening which is smaller than the area defined by the circumference of the top at the wall, the container holding a predetermined amount of an uncured fixing agent, said apparatus comprising:

an enclosure into which the container may be placed, said enclosure including a plurality of walls, a bottom and a cover, one of said walls including a door opening through which the container may be placed in said enclosure or removed from said enclosure;

said enclosure including a movable tray for supporting the container in said enclosure, and at least one lifting cylinder for raising and lowering said tray;

a removable extension which may be placed on the top of the container; said extension having a funneled wall which slopes inwardly in the downward direction and through the container opening, said extension forming a substantially sealed chamber with said enclosure cover and the container when the container is raised by said lifting cylinder so that said extension is in contact with said enclosure cover;

a rotatable blade supported by and extending downwardly from said cover, said blade being capable of entering the container through the container opening, said blade further having a lateral width which is smaller than the container opening, and a rotational axis which is displaced from the center of said blade so that the distance between the rotational axis and one edge of said blade is slightly less than the radius of said container; and a shaft secured to said blade for rotation of said blade, a cup secured to said shaft above said blade, a feed tube extending to the proximity of said cup for introducing waste materials into said cup, and an orifice in said cup for permitting the waste materials to pass from said cup into the container;

said lifting cylinder causing said blade to pass into the container through the container opening, the lateral position of said tray being controlled by at least one track guide so that when said tray is lifted by said lifting cylinder, said blade is positioned for rotation inside the container with a portion of said blade being adjacent the wall.

* * * * *